US011541920B2

(12) United States Patent
Wang et al.

(10) Patent No.: US 11,541,920 B2
(45) Date of Patent: Jan. 3, 2023

(54) SYSTEM AND METHOD FOR MONITORING PRESSURE INSIDE RAILWAY VEHICLE

(71) Applicant: CRRC QINGDAO SIFANG CO., LTD., Shandong (CN)

(72) Inventors: Zongchang Wang, Shandong (CN); Xinxi Zhou, Shandong (CN); Lei Chen, Shandong (CN); Chenglong Chu, Shandong (CN); Shudian Li, Shandong (CN); Dan Guo, Shandong (CN); Lianhao Zhao, Shandong (CN)

(73) Assignee: CRRC QINGDAO SIFANG CO., LTD., Shandong (CN)

( * ) Notice: Subject to any disclaimer, the term of this patent is extended or adjusted under 35 U.S.C. 154(b) by 350 days.

(21) Appl. No.: 16/758,416

(22) PCT Filed: Sep. 10, 2018

(86) PCT No.: PCT/CN2018/104865

§ 371 (c)(1),
(2) Date: Apr. 23, 2020

(87) PCT Pub. No.: WO2019/109697

PCT Pub. Date: Jun. 13, 2019

(65) Prior Publication Data

US 2020/0339170 A1 Oct. 29, 2020

(30) Foreign Application Priority Data

Dec. 8, 2017 (CN) ..... 201711296139.5

(51) Int. Cl.
*B61L 15/00* (2006.01)
*B61C 17/00* (2006.01)
(Continued)

(52) U.S. Cl.
CPC ..... *B61L 15/0081* (2013.01); *B61C 17/00* (2013.01); *B61D 27/00* (2013.01); *B61L 3/006* (2013.01)

(58) Field of Classification Search
CPC ..... B61L 15/0081; B61L 3/006; B61L 2201/00; B61D 27/0009
See application file for complete search history.

(56) References Cited

U.S. PATENT DOCUMENTS

2017/0232978 A1 8/2017 Zheng et al.

FOREIGN PATENT DOCUMENTS

CH 708501 A1 * 3/2015 ..... G01M 3/3272
CN 102145689 A 8/2011
(Continued)

OTHER PUBLICATIONS

Schwanitz et al.; Pressure variations on a train—Where is the threshold to railway passenger comfort; Applied Ergonomics; 44 (2013) pp. 200-209 (Year: 2013).*
(Continued)

*Primary Examiner* — Michael J Zanelli
(74) *Attorney, Agent, or Firm* — Yue (Robert) Xu; Apex Attorneys at Law, LLP

(57) ABSTRACT

A system and a method for monitoring pressure inside a railway vehicle comprise a carriage pressure detection device, a control device, and an alarm device. The control device is configured to receive and process a pressure signal collected by the carriage pressure detection device, perform calculation on and analyze the collected data, and transmit an alarm signal to the alarm device as an alarm when a preset alarm condition is met. When a pressure protection device fails, pressure changes inside the vehicle are monitored in real time by the carriage pressure detection device functioning independently of the pressure protection device.

2 Claims, 1 Drawing Sheet

(51) Int. Cl.
*B61D 27/00* (2006.01)
*B61L 3/00* (2006.01)

(56) References Cited

FOREIGN PATENT DOCUMENTS

| | | | | | |
|---|---|---|---|---|---|
| CN | 202904392 | U | * | 4/2013 | |
| CN | 203888809 | U | | 10/2014 | |
| CN | 105427529 | A | | 3/2016 | |
| CN | 105539476 | A | | 5/2016 | |
| CN | 106564513 | A | | 4/2017 | |
| DE | 3940719 | C1 | | 10/1990 | |
| DE | 19755097 | C1 | * | 6/1999 | ..... B60H 1/00735 |
| DE | 102010051662 | A1 | * | 1/2012 | ..... G01M 3/26 |
| EP | 0326044 | A2 | | 8/1989 | |
| EP | 0432669 | A2 | * | 12/1990 | ..... B61D 27/0009 |
| EP | 0622287 | A1 | | 11/1994 | |
| EP | 1298425 | A2 | | 4/2003 | |
| EP | 1308364 | A1 | * | 5/2003 | ..... B61D 27/0009 |
| EP | 1394010 | A1 | * | 3/2004 | ..... B61D 27/0009 |
| JP | H06144221 | A | | 5/1994 | |
| JP | H072097 | A | | 1/1995 | |

OTHER PUBLICATIONS

Xiang et al.; Mechanism and capability of ventilation openings for alleviating micro-pressure waves emitted from high-speed railway tunnels; Building and Environment 132 (2018) pp. 245-254 (Year: 2018).*

Sanok et al.; Passenger comfort on high-speed trains: effect of tunnel noise on the subjective assessment of pressure variations; Ergonomics, 58:6,1022-1031, (2015) DOI: 10.1080/00140139.2014.997805 (Year: 2015).*

International Search Report for PCT/CN2018/104865 dated Nov. 16, 2018, ISA/CN.

Search Report dated Jul. 28, 2021 for European patent application No. 18885413.7.

* cited by examiner

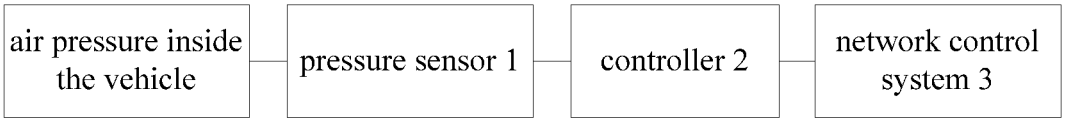
air pressure inside the vehicle
pressure sensor 1
controller 2
network control system 3

SYSTEM AND METHOD FOR MONITORING PRESSURE INSIDE RAILWAY VEHICLE

This application is the national phase of International Application No. PCT/CN2018/104865, filed on Sep. 10, 2018, which claims priority to Chinese Patent Application No. 201711296139.5, filed on Dec. 8, 2017 with China National Intellectual Property Administration, both of which are incorporated herein by reference in their entities.

FIELD

The present disclosure relates to the technical field of pressure monitoring, and in particular, to a system and method for monitoring pressure inside a railway vehicle.

BACKGROUND

When Electric Multiple Units (EMU) enters or exits a tunnel or meets each other at a high speed of more than 200 km/h, pressure fluctuations outside the vehicle are so large that the pressure fluctuations outside the vehicle will be transferred to an inside of the vehicle, which will worsen ride comfort of the vehicle, and even may cause tinnitus. In order to suppress transfer of the pressure fluctuations from outside to inside of the vehicle, control pressure fluctuations inside the vehicle, and improve the ride comfort of the vehicle, the EMU is equipped with an in-vehicle pressure protection system.

At present, there are mainly two types of the in-vehicle pressure protection system installed on the EMU: an active pressure protection system and a passive pressure protection system. The active pressure protection system is implemented by a high static pressure ventilation device. The passive pressure protection system is implemented by close of an outside air damper and a waste valve of a control device. However, whether for the active pressure protection system or the passive pressure protection system, it is different for crew members to detect a failure of said pressure protection device, which causes discomfort such as tinnitus of passengers and affects the ride comfort of the vehicle.

SUMMARY

A main technical problem to be solved by the present disclosure is to provide a system and method for monitoring pressure inside a railway vehicle, which can monitor pressure changes inside a carriage in real time when a pressure protection device fails, and promptly alert crew members to deal with the fault.

To achieve the above objective, a technical solution of the present disclosure is as follows.

A method for monitoring pressure inside a railway vehicle, including:

step 1: detecting pressure in a carriage;

step 2: comparing a pressure signal of the carriage with a preset alarm condition; and step 3: giving an alarm in a case that the pressure signal of the carriage meets the preset alarm condition.

Further, the preset alarm condition is that a pressure change rate in the carriage exceeds a first set value within a first set time.

Further, the first set value of the pressure change rate is any one of 500 Pa/s, 800 Pa/3 s, 1000 Pa/10 s and 2000 Pa/60 s.

Further, the preset alarm condition further includes a cumulative number of times that the pressure change rate exceeds the first set value within a second set time range, and the alarm is given in a case that the cumulative number of times exceeds a second set value.

Further, each carriage is provided with a pressure detection device for detecting pressure in the carriage.

Another technical solution of the present disclosure is as follows.

A system for monitoring pressure inside a railway vehicle, including a pressure detection device in a carriage, a control device, and an alarm device, where the control device is configured to receive and process a pressure signal collected by the pressure detection device, perform calculation and analyzation on collected data, and transmit an alarm signal to the alarm device for an alarm in a case that a preset alarm condition is met.

Further, the preset alarm condition is that a pressure change rate in the carriage exceeds a first set value within a first set time.

Further, the preset alarm condition further includes a cumulative number of times that the pressure change rate exceeds the first set value within a second set time range, and an alarm is given in a case that the cumulative number of times exceeds a second set value.

Further, each carriage is provided with at least one pressure detection device.

Further, the control device is an air-conditioning unit controller, and a pressure detection device of each carriage is connected to an air-conditioning unit controller of the carriage.

In the present disclosure, a system and method for monitoring pressure inside a railway vehicle are provided. After a pressure protection device fails, a pressure change inside a vehicle is monitored in real time by a carriage-in pressure detection device that is independent from the pressure protection device. As a result, an overpressure failure can be promptly detected, and crew members can be quickly notified to deal with a malfunctioning component of the pressure protection system. In this way, excessive pressure changes inside the vehicle due to the failure of the pressure protection system when the vehicle is in operation can be avoided.

BRIEF DESCRIPTION OF THE DRAWINGS

Figure is a schematic diagram of a principle of a system for monitoring pressure inside a vehicle according to an embodiment of the present disclosure.

In Figure: 1- a pressure sensor, 2- an air-conditioning unit controller, and 3- a vehicle network control system

DETAILED DESCRIPTION OF EMBODIMENTS

The present disclosure is described in further detail below with reference to the drawings and specific embodiments.

As shown in Figure, a system for monitoring pressure inside a railway vehicle is provided in the present disclosure, including a pressure detection device in a carriage, a control device, and an alarm device.

The pressure detection device in the carriage is provided separately. Preferably, the pressure detection device in the carriage is a pressure sensor 1. The pressure sensor 1 is configured to collect a pressure signal in the carriage and transmit the collected pressure signal to the control device. In this embodiment, preferably, each carriage is provided with at least one pressure sensor 1 for monitoring a pressure change in the carriage in real time. Because the pressure sensor 1 only collects a pressure value inside the carriage, an installation position of the pressure sensor is not limited, and it can be installed at any position in the carriage. For example, the pressure sensor is preferably installed in a control cabinet at an end of the carriage.

The pressure sensor 1 is connected to the control device through a control line. In this embodiment, since each carriage is provided with a pressure sensor 1, an air-conditioning unit controller 2 installed in each carriage is used as the control device, and the one or more pressure sensors 1 installed in the carriage are connected to the air-conditioning unit controller 2 of the carriage, to simplify the control manner and the control system. The air-conditioner unit controller 2 receives and processes the pressure signal collected by the pressure sensor 1, calculates on and analyzes the collected data, and transmits an alarm signal to the alarm device for an alarm when the preset alarm condition is met.

In this embodiment, the preset alarm condition is stored in the air-conditioning unit controller 2 in advance. The preset alarm condition is that a pressure change rate in the carriage exceeds a first set value within a first set time T1. The first set value of the pressure change rate is selected as any one of 500 Pa/s, 800 Pa/3 s, 1000 Pa/10 s and 2000 Pa/60 s. In this embodiment, in order to avoid a false alarm, the preset alarm condition further includes a cumulative number of times that the pressure change rate exceeds the first set value within a second set time range. When the pressure change rate exceeds any one of the above first set values, the air-conditioning unit controller 2 increases the count by one. If multiple pressure sensors 1 are installed in the carriage, the air-conditioner unit controller 2 increases the count by one as long as a pressure value detected by one of the pressure sensors 1 meets the above condition. Only when a cumulative count of the air-conditioner unit controller 2 exceeds a second set value, the alarm is given. For example, the second set time is set to be any value from 30 to 60 minutes, and the second set value is equal to or greater than 2. Preferably, the second set time is 40 minutes and the second set value is 3, that is, the alarm signal is issued only when it is detected that the pressure change rate meets the first set value for at least 3 times within 40 minutes.

In order to facilitate monitoring an internal pressure of each carriage in a driver's cab, the alarm device is set on a monitor of the driver's cab. When the air-conditioning unit controller 2 determines that the preset alarm condition is met, the alarm signal is transmitted to the vehicle network control system 3, and finally a pop-up alarm is given on a monitoring screen of the driver's cab for crew members to find the overpressure failure in time. The crew members are notified to deal with a malfunctioning component of the pressure protection system, and thus excessive pressure changes inside the vehicle due to the failure of the pressure protection system when the vehicle is in operation can be avoided.

The following describes the method for monitoring pressure inside a railway vehicle in detail. The method includes the following steps.

In step 1, pressure in a carriage is detected.

At least one pressure sensor 1 installed in each carriage is used to detect a pressure change in the carriage, and a collected pressure value is transmitted to an air-conditioning unit controller 2 of the carriage in real time.

In step 2, a pressure signal of the carriage is compared with a preset alarm condition.

The air-conditioner unit controller 2 receives the pressure signal collected by the pressure sensor 1, and calculates on and analyses the collected data. The step of calculation and analysis is mainly to compare the collected pressure signal with a pre-stored preset alarm condition.

The preset alarm conditions include two conditions. One condition is that a pressure change rate in the carriage exceeds a first set value within a first set time T1. The first set value of the pressure change rate is selected as any one of 500 Pa/s, 800 Pa/3 s, 1000 Pa/10 s and 2000 Pa/60 s. The other condition is a cumulative number of times that the pressure change rate exceeds the first set value within a second set time range, that is, whether the cumulative number of times exceeds a second set value.

Specifically, when the air-conditioning unit controller 2 analyzes out that the pressure change rate exceeds one of 500 Pa/s, 800 Pa/3 s, 1000 Pa/10 s, 2000 Pa/60 s, it increases the count by one, and the cumulative number of times within 40 minutes is greater than or equal to 3.

In step 3, an alarm is given in a case that a detected value of the pressure in the carriage meets the preset alarm condition.

When the air-conditioning unit controller 2 compares the pressure signal collected in real time with the pre-stored preset alarm condition and determines that the pressure signal meets the above two preset alarm conditions, it transmits an alarm signal of "pressure over-limit fault" to the vehicle network control system 3, and finally a pop-up alarm is given on a monitoring screen of the driver's cab.

A driver determines a carriage with abnormal pressure based on the alarm information, and then determines that the pressure protection system installed in the carriage has failed and informs relevant personnel to deal with the malfunctioning component of the pressure protection system of the carriage in a timely manner, to ensure a normal operation of the vehicle and improve the ride comfort of the vehicle.

The system for monitoring pressure inside a vehicle provided by the present application is used in conjunction with a pressure protection system installed in the vehicle. The pressure sensor 1 is independent from the pressure protection system in the vehicle, and is used to monitor the pressure change in the vehicle in real time. When the pressure protection system in the vehicle fails due to failure, an alarm is given by the pressure monitoring system in the vehicle, to timely alter the relevant personnel that the pressure protection system in the carriage fails and the pressure in the vehicle is abnormal, and deal with a malfunctioning component of the pressure protection system of the carriage, so as to improve the ride comfort of the vehicle.

As described above, similar technical solutions can be derived in combination with the content of the solutions given in the drawings. As long as it does not depart from the technical solution of the present invention, any simple modifications, equivalent changes, and modifications made to the above embodiments according to the technical essence of the present invention still fall within the scope of the technical solution of the present invention.

The invention claimed is:

1. A method for monitoring pressure inside a railway vehicle, comprising:

detecting, by a pressure detection device provided in each carriage of the railway vehicle, pressure in the carriage;

sending a pressure signal of the detected pressure to an air-conditioning unit controller of the carriage;

comparing, by the air-conditioning unit controller, the pressure signal of the carriage with a preset alarm condition, wherein the preset alarm condition is that a pressure change rate in the carriage exceeds a first set value within a first set time and a cumulative number of times that the pressure change rate exceeds the first set value within a second set time range, wherein the first set value of the pressure change rate is any one of 500 Pa/s, 800 Pa/3 s, 1000 Pa/10 s and 2000 Pa/60 s; and giving an alarm signal to a vehicle network control system in a case that the pressure signal of the carriage meets the preset alarm condition, wherein the alarm indicates that a pressure protection system installed in the carriage has failed.

2. A system for monitoring pressure inside a railway vehicle, comprising a pressure detection device in each carriage of the railway vehicle, an air-conditioning unit controller of the carriage, and a vehicle network control system, wherein the pressure detection device provided in each carriage is configured to detect pressure in the carriage and send a pressure signal of the detected pressure to the air-conditioning unit controller of the carriage;

the air-conditioning unit controller is configured to compare the pressure signal with a preset alarm condition, wherein the preset alarm condition is that a pressure change rate in the carriage exceeds a first set value within a first set time and a cumulative number of times that the pressure change rate exceeds the first set value within a second set time range, wherein the first set value of the pressure change rate is any one of 500 Pa/s, 800 Pa/3 s, 1000 Pa/10 s and 2000 Pa/60 s, and the air-conditioning unit controller further configured to give an alarm signal to the vehicle network control system in a case that the pressure signal of the carriage meets the preset alarm condition, wherein the alarm indicates that a pressure protection system installed in the carriage has failed.

* * * * *